United States Patent [19]

Elaschuk

[11] 3,934,805

[45] Jan. 27, 1976

[54] APPLIANCE BASE

[75] Inventor: George Elaschuk, Mississauga, Canada

[73] Assignee: Domtar Limited, Montreal, Canada

[22] Filed: Sept. 23, 1974

[21] Appl. No.: 508,194

[30] Foreign Application Priority Data

Oct. 3, 1973 Canada ..... 182593

[52] U.S. Cl. ..... 248/346; 108/51; 206/320

[51] Int. Cl.[2] ..... B65D 85/00

[58] Field of Search ..... 248/346; 108/56, 51, 57; 229/37 E, 23 A, 14 C, 28 R; 206/320, 386; 52/618, 625

[56] References Cited

UNITED STATES PATENTS

| | | | |
|---|---|---|---|
| 2,446,914 | 8/1948 | Fallert et al. | 229/14 C |
| 2,728,479 | 12/1955 | Wheeler | 229/14 C X |
| 2,894,671 | 7/1959 | Nicholls | 229/14 C |
| 2,925,947 | 2/1960 | Brown | 229/14 C |
| 2,957,668 | 10/1960 | Norquist et al. | 108/56 |
| 2,960,217 | 11/1960 | Nason | 229/14 C |
| 3,079,876 | 3/1963 | Doane | 108/56 |
| 3,101,652 | 8/1963 | Imielinski | 229/28 R X |
| 3,167,038 | 1/1965 | Brown | 108/56 |
| 3,661,099 | 5/1972 | Shelor | 108/56 X |

*Primary Examiner*—Roy D. Frazier
*Assistant Examiner*—Rodney H. Bonck
*Attorney, Agent, or Firm*—C. A. Rowley

[57] ABSTRACT

A combination appliance base and carton bottom is disclosed. The base includes a top panel and a bottom panel with a reinforcement therebetween. The reinforcement includes a pair of beam members one on each side of the base and a reinforcing filler in the central portion. The beam members and reinforcing filler are formed of substantially non-expanded and expanded honeycomb material, respectively.

8 Claims, 8 Drawing Figures

APPLIANCE BASE

FIELD OF THE INVENTION

The present invention relates to an appliance base, more specifically the present invention relates to a combined appliance and carton base incorporating a reinforced deck and locking flaps.

DESCRIPTION OF THE PRIOR ART

Generally, during the manufacture of appliances, each appliance is mounted on a frame, usually formed of wood or the like, and generally referred to as an appliance base. The appliance is carried along the assembly line on its base and subsequently the finished appliance and base are inserted into a suitable container, such as a conventional corrugated cardboard box to package the appliance for shipment. It will be apparent that with this system, the carton is a separate entity entirely from the appliance base, serves a different purpose and the appliance together with its base must be lifted or supported in an elaborate manner to permit the bottom of the carton to be positioned or formed under the appliance.

It is the object of the present invention to provide a combined appliance and carton base and a new carton structure for packaging appliances.

SUMMARY OF THE INVENTION

Broadly, the present invention comprises a base member having a bottom panel and a top panel, a reinforcement positioned between and spacing said top and bottom panels, said reinforcement comprising a pair of beam members positioned one at each side of said base and a reinforcing filler positioned between said beam, said reinforcing filler comprising expanded honeycomb material positioned with the longitudinal axis of the passages formed through the honeycomb material perpendicular to said top and bottom panels and wherein said reinforcing beams comprise substantially non-expanded or partially expanded honeycomb material. Preferably, the honeycomb material of the reinforcing filler and the beam members is formed of strips of double faced corrugated material secured together at spaced intervals with the points of securement on one side of each strip of corrugated material being staggered relative to those on the opposite side thereof.

BRIEF DESCRIPTION OF THE DRAWINGS

Further features, objects and advantages will be evident from the following detailed description of a preferred embodiment of the present invention taken in conjunction with the accompanying drawings in which.

DESCRIPTION OF THE PREFERRED EMBODIMENTS

Figure 1:
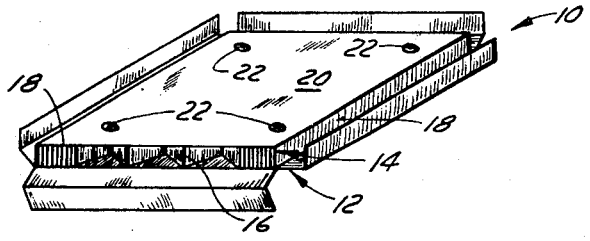
FIG. 1 is an isometric view of the appliance base constructed in accordance with the present invention.

The appliance base 10 of the present invention is illustrated schematically in isometric section in FIG. 1. As shown, the base 10 comprises a bottom panel 12, an intermediate reinforcement 14 including a filler section 16 and a pair of side beams 18 positioned one at each side of the base 10. The reinforcement 14 is covered by a top panel 20. Suitable anchoring holes 22 are provided through the top panel 20 to coincide with depressions 19 in the bearing beams 18 of the reinforcement 14.

Figure 8:
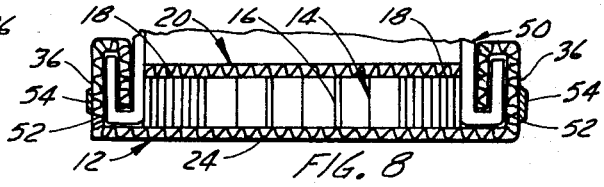
FIG. 8 is a section along the line 8-8 of FIG. 7 illustrating the appliance base and its connection to the side walls (and/or end walls) of the carton.

The bottom panel 12 in the illustrated arrangement includes a main body panel 24 having opposed pairs of closure flaps 26 and 28 foldably connected to opposite sides thereof by fold lines 30 and 32 respectively. Each of the flaps 26 is divided by fold line 34 into an outer panel 36 and an inner flap 38. Similarly each of the flaps 28 is divided by a fold line 40 into an outer panel 42 and an inner flap 44. The flaps 38 and 44 are designated as inner flaps even though they are on the outer extremities of the panels 36 and 42 respectively because of their final position in the shipping container. The length and width of the body portion 24 are slightly longer (by approximately 2 thicknesses of board) than the corresponding dimensions of the top panel 20 thereby to accommodate the tubular sleeve 50 as will be described hereinbelow (see FIG. 8).

Figure 5:
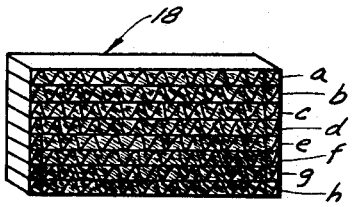
FIG. 5 is an isometric view of non-expanded honeycomb material used for the reinforcing beams.
Figure 2:
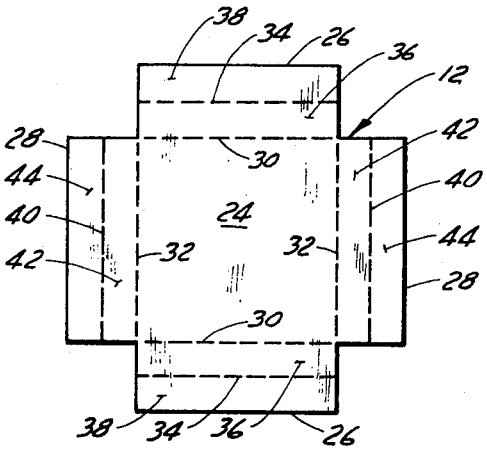
FIG. 2 is a plan view of the bottom blank.
Figure 3:
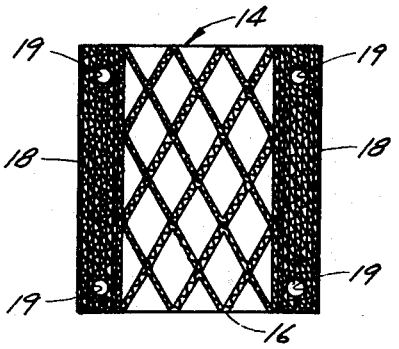
FIG. 3 is a plan view of one form of reinforcement including the reinforcing filler and beam structure.
Figure 4:
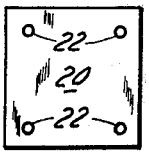
FIG. 4 is a plan view of the top panel of the base.

Referring to FIG. 3, the reinforcement 14 as above indicated comprises a central reinforcing filler 16 between the two bearing beams 18. The central filler 16 functions as a reinforcing and spacer between the panels 12 and 20 and preferably is formed of an expanded honeycomb material. The bearing beams 18 may simply be formed of the same material as the filler 16 but in its unexpanded or slightly expanded condition. The preferred form of such a material is shown in FIG. 5 and includes a plurality of layers of double-faced corrugated board (i.e. a corrugated board having a pair of liners with a corrugated medium secured therebetween). Adjacent layers are adhesively secured together at spaced intervals by securing points 46 positioned so that those on one side of each of the layers are staggered relative to the securing points 46 on the opposite sides thereof whereby upon expansion the honeycomb like material will be formed. In the arrangement illustrated in FIG. 5, the various layers are designated as A, B, C, D, E, F, G and H. However, as many layers as desired may be used assuming equipment to form the material of the desired height is available.

On expanding the material of FIG. 5, for example to form the filler 16, the various layers are bent around their securing points 46 to form a honeycomb-like structure having passages 48.

If desired, the filler section 16 and the two bearing beams 18 may be formed from a single sheet of honeycomb material with different degrees of expansion so that the central region forming the filler is substantially more expanded than the bearing beams 18 as illustrated. Preferably, the beams 18 will be substantially non-expanded.

The top panel 20 is simply a rectangular panel formed preferably as is the bottom panel 12 of conventional double-faced corrugated board. In the specific arrangement shown, suitable mounting holes 22 are cut through the panel 20 to coincide with depressions 19 in the beams 18.

To form the appliance base, it is simply necessary to secure the reinforcement 14 to either the panel 20 or the panel 12 in proper relation thereto and then to secure the other panel, i.e. either 12 or 20 to the opposite side of the reinforcement thereby to form the three layered laminate.

It will be noted that the appliance base 10 is relatively rigid, the rigidity being provided by the two spaced panels 12 and 20 with the reinforcement 14 functioning as the spacing element and as the reinforcement to prevent bending and twisting of the base 10. In the illustrated arrangement, only two beam members 18 have been shown but obviously more may be provided as desired, for example further beam members parallel or perpendicular to the illustrated beams may be appropriately located in the base.

Figure 7:
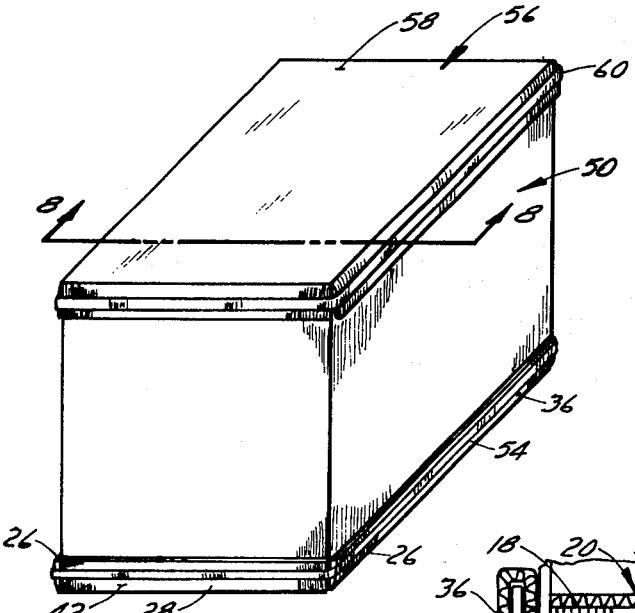
FIG. 7 is an isometric view of a closed carton formed in accordance with the present invention.
Figure 6:
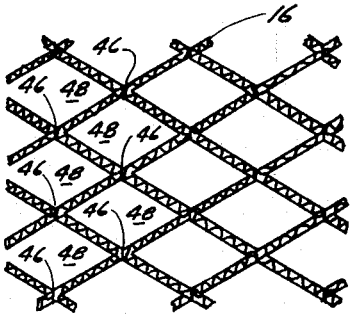
FIG. 6 is a partial view of an expanded honeycomb material forming the filler and is essentially the same material as FIG. 5 but in expanded position.

The appliance base 10 with the built-in bottom panel 12 which functions as the bottom of the carton facilitates the packaging operation in the appliance manufacturer's plant since the appliance is initially mounted on the base 10 and then fed through the assembly line. After the appliance has been fabricated, it may be packaged simply by slipping a tubular sleeve generally indicated at 50 in FIG. 7 down over the appliance. The sleeve will be provided with suitable flaps to cooperate with the flaps 26 and 28, a pair of such flaps generally indicated at 52 are shown in cooperation with a pair of flaps 26 in the crosssection illustrated in FIG. 8. In this arrangement, the sleeve 50 is slid down over the appliance with the flaps 52 folded perpendicularly to their respective walls until the flaps 52 lie in face-to-face relationship with the outer panels 36 (or 42), the inner flaps 38 (or 44) are folded over the flaps 52 on fold lines 34 (or 40) and then the flaps 26 (or 28) and 52 are folded into a position substantially perpendicular to the panel 24, i.e. into the position illustrated in FIG. 8. A suitable strap 56 may be applied around the base of the carton to secure the sleeve 50 into position.

The top of the container may be formed in any suitable manner. In the illustrated arrangement, it is provided by a lid member 56 having a top panel 58 and downwardly extending flaps (equivalent to the flaps 26 and 28) which encircle a further flap provided around the top of the sleeve 50 (equivalent to the flaps 52 described hereinabove) and the top is closed via a band 60 which functions in the same manner as the band 54 described hereinabove. Alternatively the top closure may be integral with the sleeve 50 or may be formed in any other suitable manner.

Modifications may be evident to those skilled in the art without departing from the spirit of the invention as defined in the appended claims.

I claim:

1. A base member comprising a top and bottom panel, a reinforcement extending between and spacing said top and bottom panels, said reinforcement having a pair of beam members positioned one at each side of said base and a reinforcing filler in the space between said beam members, said reinforcing filler being formed by an expanded honeycomb material oriented so that the longitudinal axes of apertures formed through the expanded honeycomb extend substantially perpendicular to said top and bottom panels, said beams being formed of honeycomb material oriented in the same manner as said expanded honeycomb forming said filler, said honeycomb material of said beams being expanded to a lesser degree than said expanded honeycomb material of said filler.

2. A base as defined in claim 1 wherein said beams are formed of substantially non-expanded honeycomb material.

3. A base member as defined in claim 2 wherein the said honeycomb material of said beam members and expanded honeycomb material of said filler are formed of double-faced corrugated board and wherein the longitudinal axis of the corrugations of the medium of said double-faced corrugated board is substantially perpendicular to said panels.

4. A base member as defined in claim 1, wherein said beam members and said filler are formed from a single piece of honeycomb material.

5. A base member as defined in claim 1 further comprising locking flaps foldably connected to the sides and end edges of said bottom panel.

6. A base member as defined in claim 2 further comprising locking flaps foldably connected to the sides and end edges of said bottom panel.

7. A base member as defined in claim 3 further comprising locking flaps foldably connected to the sides and end edges of said bottom panel.

8. A base member as defined in claim 5, wherein each of said locking flaps has a panel with a flap foldably connected thereto on a fold line substantially parallel to the foldable connection between each respective locking flap and said bottom panel.

* * * * *